US006682392B2

(12) United States Patent
Chan

(10) Patent No.: US 6,682,392 B2
(45) Date of Patent: Jan. 27, 2004

(54) PHYSICALLY INTERACTIVE ELECTRONIC TOYS

(75) Inventor: Albert Wai Chan, Hong Kong (CN)

(73) Assignee: Thinking Technology, Inc., Nassau (BM)

( * ) Notice: Subject to any disclaimer, the term of this patent is extended or adjusted under 35 U.S.C. 154(b) by 0 days.

(21) Appl. No.: 09/837,340

(22) Filed: Apr. 19, 2001

(65) Prior Publication Data

US 2002/0155783 A1 Oct. 24, 2002

(51) Int. Cl.[7] ..... A63H 13/06

(52) U.S. Cl. ..... 446/335; 446/484; 446/236; 446/175

(58) Field of Search ..... 446/175, 335, 446/90, 91, 236, 333, 334, 477, 118, 102, 103, 330, 336, 357; 40/414, 411; 340/686.6, 686.1, 539.23

(56) References Cited

U.S. PATENT DOCUMENTS 2,115,533 A * 4/1938 Myers ..... 200/61.01
3,881,274 A * 5/1975 Kanda ..... 434/401
4,299,386 A * 11/1981 Kulesza et al. ..... 273/440.1
4,712,184 A * 12/1987 Haugerud ..... 377/16
4,938,483 A * 7/1990 Yavetz ..... 446/175
4,949,327 A * 8/1990 Forsse et al. ..... 369/53.31
5,013,276 A * 5/1991 Garfinkel ..... 446/14
5,108,307 A * 4/1992 Cohen ..... 40/411
5,267,886 A * 12/1993 Wood et al. ..... 446/175
5,412,890 A * 5/1995 Fechter ..... 40/414
5,438,154 A * 8/1995 Segan et al. ..... 368/273
5,445,552 A * 8/1995 Hine ..... 362/249
5,452,901 A * 9/1995 Nakada et al. ..... 446/175
5,732,953 A * 3/1998 Tamura ..... 273/440.1
5,746,602 A * 5/1998 Kikinis ..... 369/30.02
5,779,515 A * 7/1998 Chung ..... 446/102
5,989,092 A * 11/1999 McGowan et al. ..... 40/411
6,110,000 A * 8/2000 Ting ..... 446/175
6,149,490 A * 11/2000 Hampton et al. ..... 446/353
6,193,580 B1 * 2/2001 Albert et al. ..... 446/297
6,206,745 B1 * 3/2001 Gabai et al. ..... 446/175
6,227,931 B1 * 5/2001 Shackelford ..... 434/156
6,246,927 B1 * 6/2001 Dratman ..... 369/63
6,309,275 B1 * 10/2001 Fong et al. ..... 446/175
6,319,010 B1 * 11/2001 Kikinis ..... 369/63

FOREIGN PATENT DOCUMENTS

JP 11179061 A * 7/1999 ..... A63H/3/38
WO WO 200015316 A2 * 3/2000 ..... A63H/00/00

* cited by examiner

*Primary Examiner*—Derris H. Banks
*Assistant Examiner*—Urszula M Cegielnik
(74) *Attorney, Agent, or Firm*—Kramer & Amado, P.C.; Gordon J. Zimmerman, Esq.

(57) ABSTRACT

An electronic toy with at least one moving part, comprising a pre-programmed integrated circuit and at least one electric motor, is adapted to perform actions. Multiple such toys may be inter-connected in different combinations and programmed to interact in groups of two or more.

20 Claims, 6 Drawing Sheets

PHYSICALLY INTERACTIVE ELECTRONIC TOYS

FIELD OF THE INVENTION

The field of this invention is electronic toys, and in particular electronic toys which interact with persons or with each other.

BACKGROUND TO THE INVENTION

Electronic toys are becoming more common. Electronic toys which can move under the influence of electric motors and generate sounds with the use of programmed integrated circuits and sound generation apparatus, are at the leading edge of existing toy technology. Such toys can be pre-programmed to carry out certain actions at specific or random times, or can be triggered to perform such actions by means of touch or sound. For example, a finger touch on a specified portion of the toy, or vibration of the toy, or the generation of sound such as by the clapping of hands or loud speech may trigger a response from the toy.

Nonetheless, these stimuli which trigger the toy to take certain actions tend to be across a broad spectrum of sounds or touch. It would be an advantage to choose a means to receive a signal which is more focussed and can be tuned to the characteristics of the particular toy. In addition, pairs of certain leading edge prior art toys may appear to interact when one toy is triggered to make a sound which in turn triggers the second to commence making sounds, perhaps with the addition of certain movements. These actions are not truly synchronized but merely occur when one toy reacts to a stimulus which happens to be provided by the other toy.

It would be a further advantage to have toys that truly interact in a synchronized fashion, both with sound and action, in order to create a reproducible action scene.

SUMMARY OF THE INVENTION

Accordingly, in one aspect of the invention, an electronic toy comprises a pre-programmed integrated circuit, at least one electric motor adapted to create movement in at least one moving part of the toy, and a motion sensor, wherein when the motion sensor detects a movement, a signal is generated within the toy which triggers the integrated circuit to control the electric motor or motors to create particular actions by moving at least one moving part of the toy.

In a further aspect, the invention comprises an ensemble of electronic toys comprising a first toy and a second toy, wherein each toy comprises a pre-programmed integrated circuit, at least one electric motor, at least one moving part, means to generate a signal, and means to link each toy's integrated circuit to the integrated circuit of a neighbouring toy, such that when a signal is generated and the integrated circuits of each toy are linked, each toy will interact with the other in a synchronized manner according to a first selected program embedded on the integrated circuit of each toy.

In a further aspect, the ensemble additionally comprises a third toy comprising the essential elements of the first and second toys, such that when a signal is generated, the first toy will interact with the second toy and the third toy will interact with the second toy, in a synchronized manner, according to a second selected program embedded on the integrated circuit of each toy.

In a further aspect, the invention additionally comprises further similarly configured toys adapted to interact in a synchronized manner according to the identity and location of each toy.

In a further aspect of the invention, each toy of the ensemble of electronic toys comprises a self-contained power source comprising one or more batteries. When a toy is linked to one or more neighbouring toys, the batteries of all such linked toys are connected in series creating a single current and voltage in all linked toys.

Further aspects of the invention will become apparent from the following drawings and description.

BRIEF DESCRIPTION OF THE DRAWINGS

FIGS. 3, 3A, 3B and 3C each illustrate an interaction of two toy characters from a set of three toy characters.

DETAILED DESCRIPTION OF THE INVENTION

Figure 1:
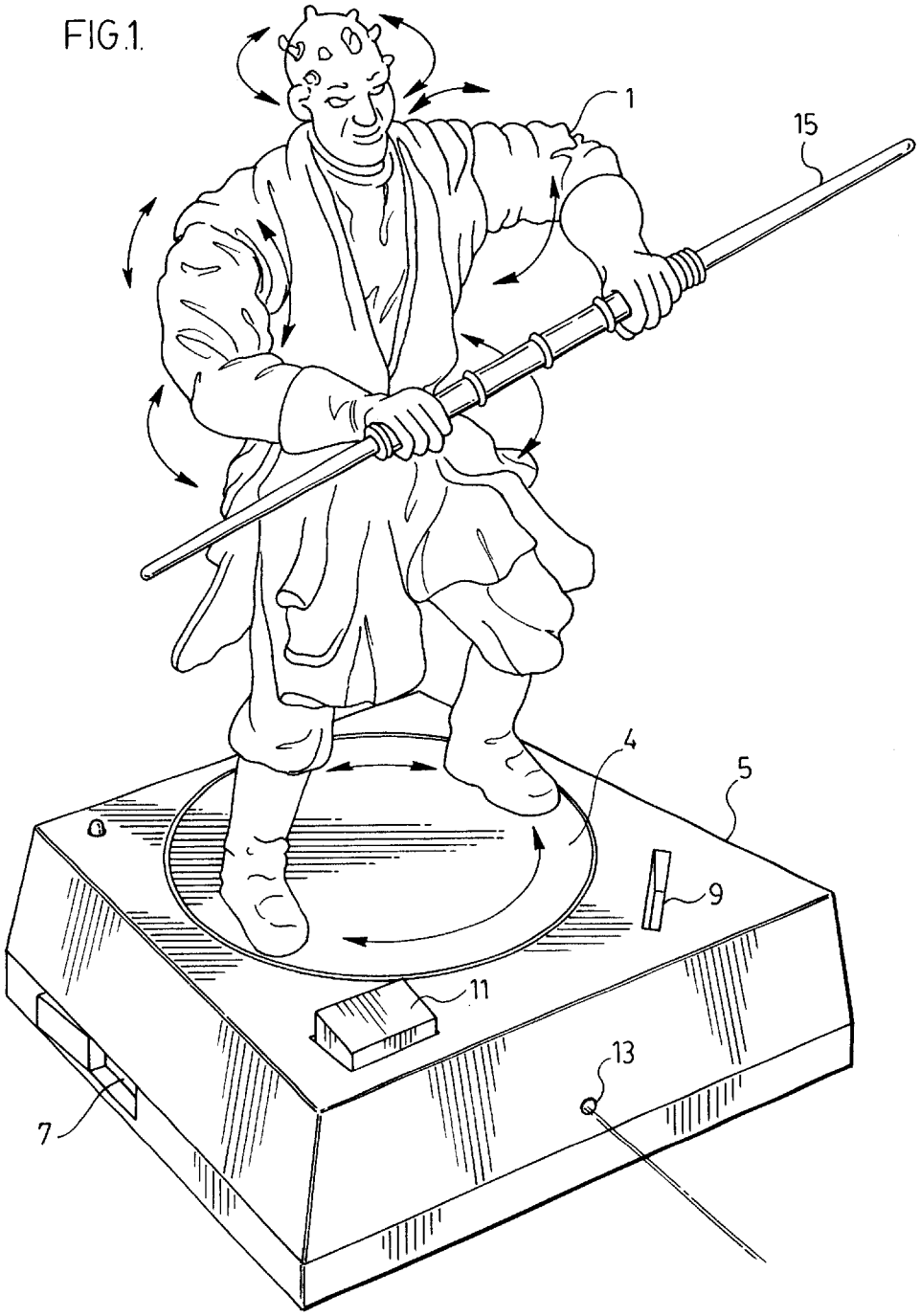
FIG. 1 is a perspective view of a single toy of the invention.

An electric toy comprises a source of electrical power, motive means to move various moving parts, and integrated circuit means to control various functions. Referring to FIG. 1, a toy FIG. 1, such as an action figure, is mounted atop a rotating table 4 on a base 5 permitting the FIG. 1 to rotate back and forth in a circular motion about a vertical axis passing through the center of the rotating table 4. In addition, within the figure are located multiple electric motors 8 adapted to move specific moving parts of the figures in specific ranges of motion, as illustrated in FIG. 1. When the multiple motors are made to simultaneously create movement of different moving parts, complex movements can be created.

An integrated circuit (not shown) located within the base 5 of the toy is pre-programmed to generate, by controlling the various electric motors, a number of different sets of movements appropriate to different circumstances. For example, a first set of motions may be appropriate to the figure acting on its own. A second set of motions may be appropriate to the figure interacting with a second figure adapted to be linked to one side of the first figure. A third set of motions may be appropriate for interaction of the first figure with a third figure adapted to be linked to the base of the first figure on the opposite side. Yet a fourth set of movements may be appropriate when the first figure is linked to both the second and third figure at the same time, as will be discussed more fully below.

The base 5 of each toy is provided with connecting means to link one toy to another. Typically, these means will be an electrical socket 7 or other suitable connector. Additionally, the link between toys may be formed by non-contact electromagnetic signals such as infra red or radio wave spectrum signals (not shown).

Figure 2:
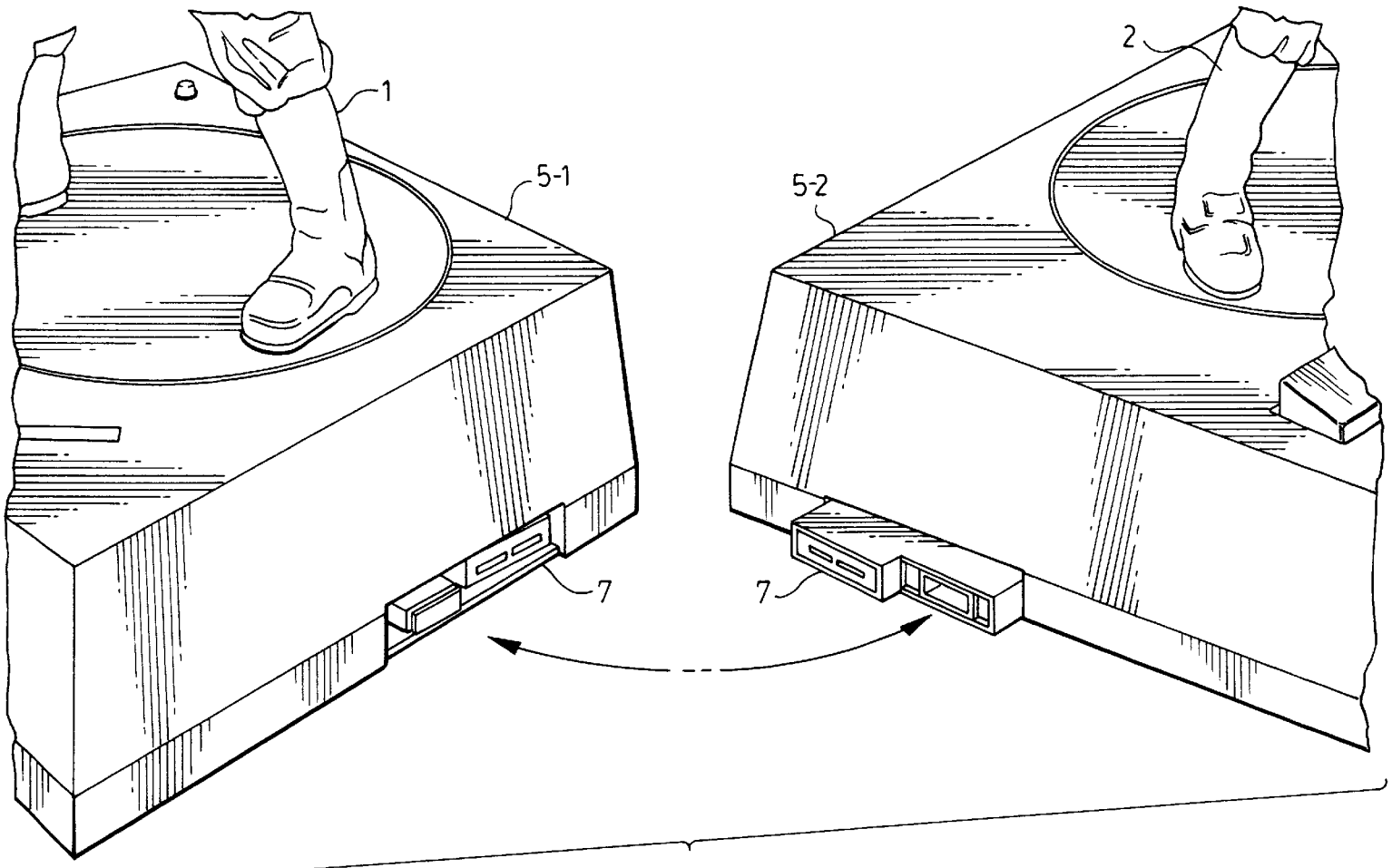
FIG. 2 is a cut-away view illustrating the connection between two toys of the invention.

In the particular embodiment illustrated, each of action FIGS. 1, 2 and 3 is provided with a sword 15. Each action figure is individually programmed to perform an action and to speak words with appropriate sounds in order to create a unique individual performance. One or more audio speakers (not shown) reproduce these sounds under the control of integrated circuits in co-ordination with synchronized corresponding movements of the character or action figure. Each figure may represent a different character with a particular persona. In the case of characters taken from a motion picture or television program, portions of the sound track from such productions may be recorded onto the integrated circuits. The actions performed by the figures may be life-like or robotic.

Figure 3A:
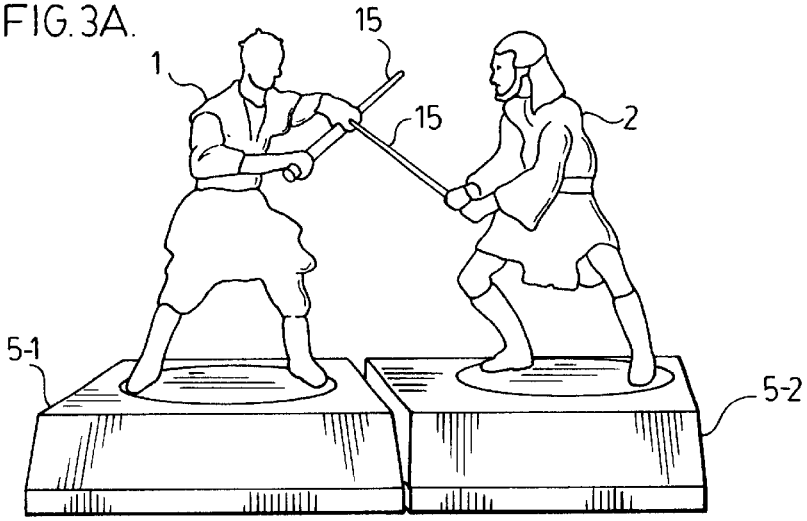
Figure 3B:
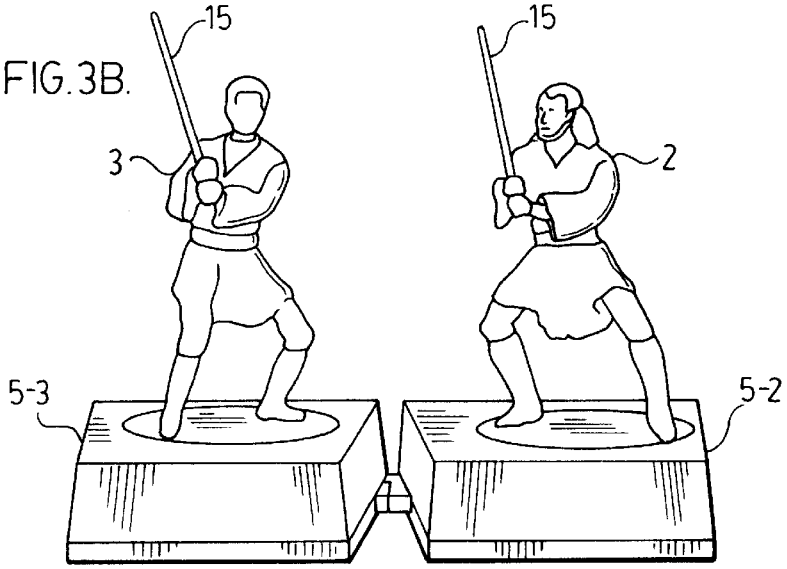
Figure 3C:
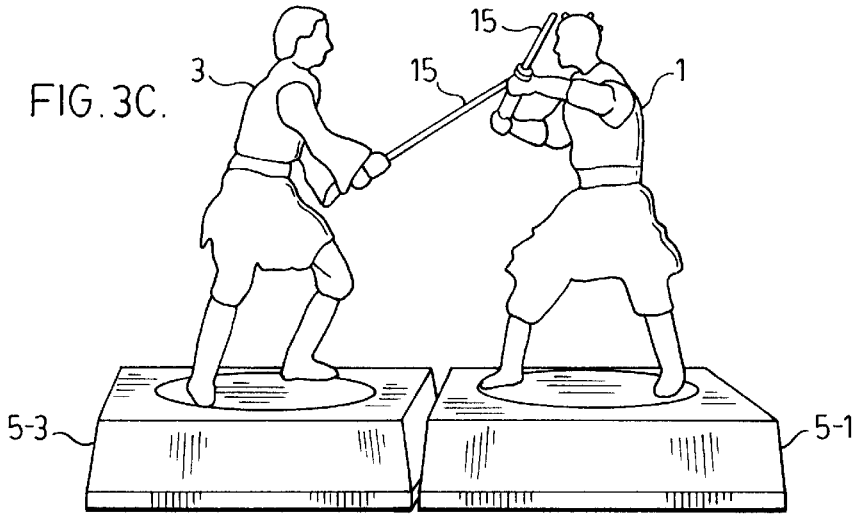
Figure 4B:
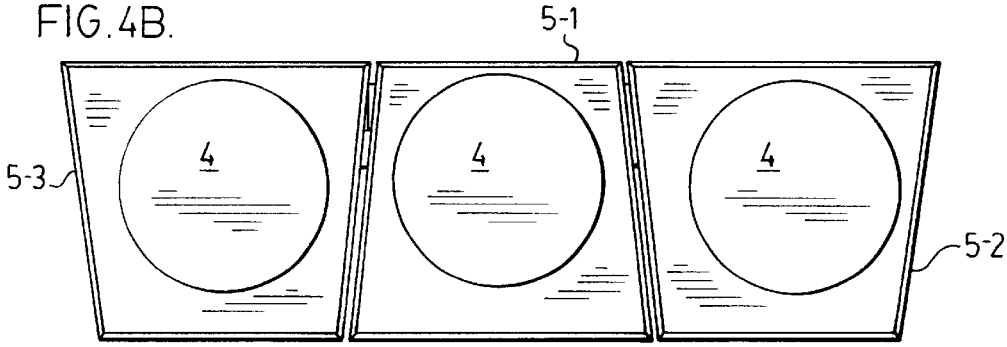
FIGS. 4A and 4B illustrate the bases of three toys prior to and after inter-connection, respectively.
Figure 4A:
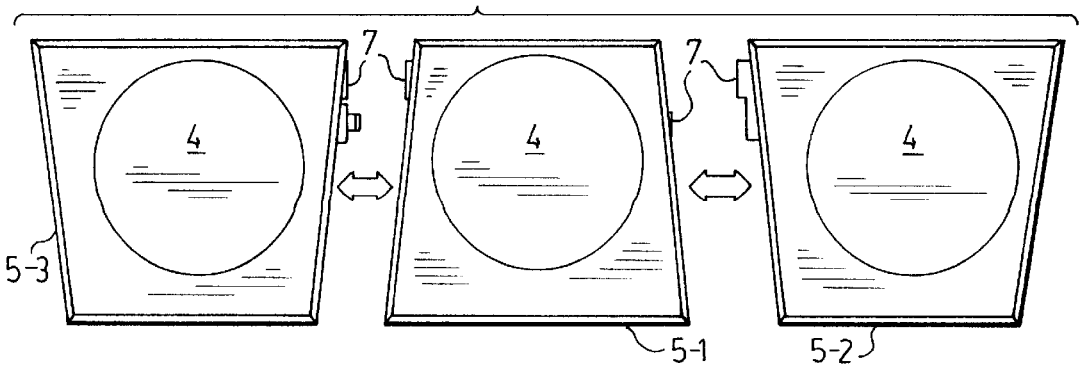
Figure 5:
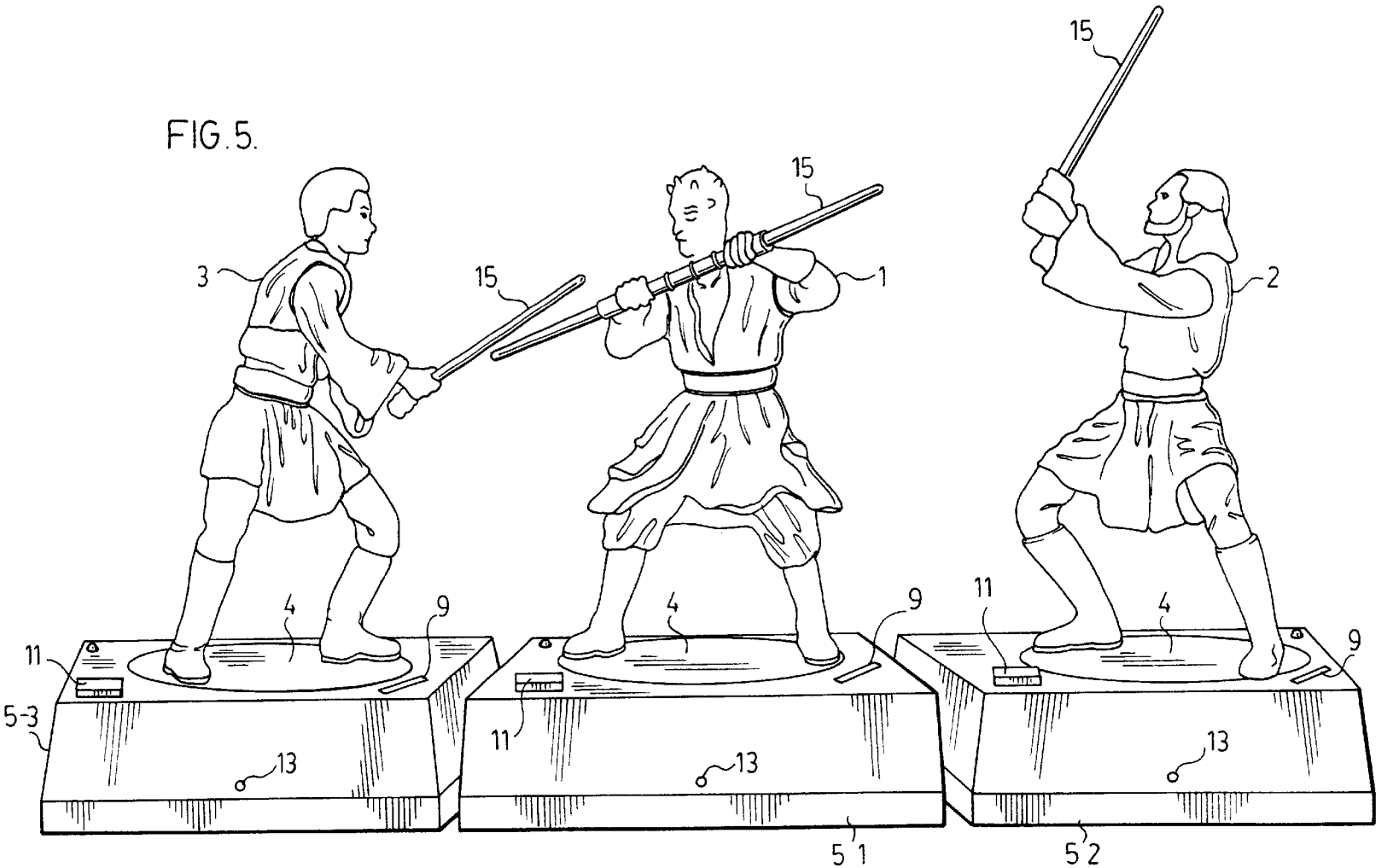
FIG. 5 illustrates three toys connected and interacting physically.
Figure 6:
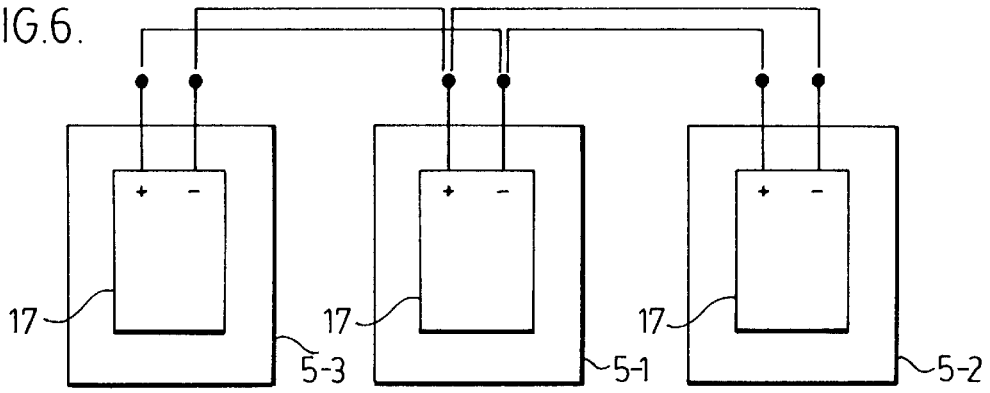
FIG. 6 is a schematic representation of the batteries of each toy connected in series to maximize the voltage for any connected toys.
Figure 7:
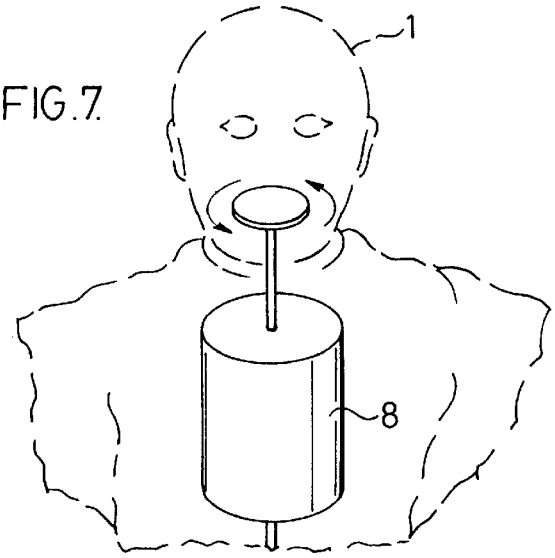
FIG. 7 schematically illustrates a portion of a figure being rotated by an electric motor.
Figure 8:
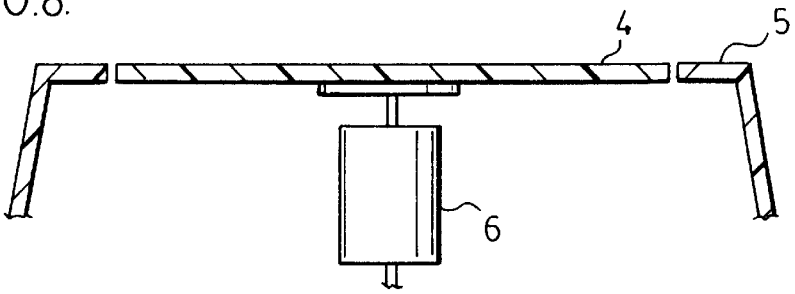
FIG. 8 schematically illustrates a rotating table being rotated by an electric motor.

One of the remarkable features of the illustrated invention is the ability of the individual toys to interact. Each character is programmed to interact with one or more other characters. In the embodiments illustrated, character 1 may interact either with character 2, as illustrated in FIG. 3A, or character 3, as illustrated in FIG. 3C. When a connection is made allowing signals to pass from one toy to another, each is able to generate a set of sounds and activities appropriate to the particular interaction in question. For example, if character 2 and character 3 are intended to be allies, their interaction with swords, as illustrated in FIG. 3B, could be a training exercise. Yet if either interacts with character 1, an enemy, their interaction will be a battle.

Since each toy may be provided with electrical connections on either side of the toy, choices as to where to place electrical connectors appropriate to the combination can be made. For example, the allies, characters 2 and 3, need only face each other in one direction, so oppositely facing connectors would be appropriate for such toys. If each of characters 2 and 3 is provided with only a single connector, then character 1 will have a connector in each side of the base, to be able to interact with each of characters 2 and 3 individually. With this arrangement of connectors, character 1 can be placed between characters 2 and 3 to do battle with both simultaneously. In this scenario, the provision of a double bladed sword to character 1 facilitates such a battle. Thus, as illustrated in FIGS. 2, 3A, 3B, 3C, 4A, 4B and 5, character 1 sits atop base 5-1, while characters 2 and 3 sit atop bases 5-2 and 5-3 respectively.

Each unit may be individually powered by a set of batteries 17, or may be adapted to be plugged into a wall electrical outlet. If two or more such toys are intended to interact together, then it is essential that their movements be synchronized. Accordingly, it is an advantage that the power source for all linked units be constant. This can be accomplished using electricity from wall outlets. In a further development, if each unit contains a pack of batteries, the batteries of linked toys can be connected in series. This provides a large steady current for both units at the voltage of the battery pack which has the higher voltage. As toys are used, and the voltage drops, the highest voltage of linked toys will always govern.

This is a major advantage since these toys can be used separately, thus placing different loads on their individual battery packs, yet when they are linked together, a single voltage and current will be generated to allow them to function in a synchronous manner.

The manner in which the toys may be triggered to commence actions along with sound, if desired, may be diverse. For example, if the toy can also function as a coin bank, the deposit of a coin into a coin slot 9 can be used to trigger an action through vibration, changes in electric or magnetic fields, or other known methods. Alternatively, a button 11 to activate a switch, or a touch sensitive surface on the toy can be used to trigger the toy to commence action or sound.

In the toy of the present invention, additionally, the action may be triggered by motion. Use of a short range CDS motion detector 13 permits the toy to be stimulated into action by a hand motion close to the toy. Extraneous distant motions will not affect the toy. Such hand motions can be tailored to the character of the action figure in question. Alternatively, if more distant motion is intended to trigger action in the figure, an appropriate form of motion detector can be used. A longer range motion detector might be useful when the toy is to act, for example, as a room guard such as for a child's room. The short range motion detector would be more appropriate when the toy is to respond to a particular hand signal from the child. The motion detector may have pre-selected characteristics, or may be tuneable for direction, height and range.

Although a preferred embodiment of the invention has been described, the invention is not to be taken as so limited. Modifications and variations to the invention described will be apparent to persons skilled in the art.

What is claimed is:

1. An electronic toy set comprising:

a first electronic toy on a first rotating platform having at least one action part, a first transmitter and first receiver, a first means for moving the action part and a first integrated circuit programmed to respond to the first receiver and control the first means for moving the action part through a first predetermined sequence;

a second electronic toy on a second rotating platform having at least one action part, a second transmitter and second receiver, a second means for moving the action part and a second integrated circuit programmed to respond to the second receiver and control the second means for moving the action part through a second predetermined sequence; and wherein the first transmitter sends a first signal to the second receiver and the second receiver activates the second integrated circuit to move the action part of the second electronic toy through the second predetermined sequence.

2. The electronic toy set of claim 1 wherein the second transmitter responds to the first signal by sending a second signal to the first receiver and the first receiver activates the first integrated circuit to move the action part of the first electronic toy through the first predetermined sequence.

3. The electronic toy set of claim 2, wherein the first and second predetermined sequences are synchronized.

4. The electronic toy set of claim 3, wherein the synchronization is maintained through information contained in the first and second signals.

5. The electronic toy set of claim 4, wherein the synchronized movement of the action parts simulates a sword fight between the first and second electronic toys.

6. The electronic toy set of claim 2, wherein the predetermined sequences include rotation movement provided by the first and second rotating platforms.

7. The electronic toy set of claim 6, wherein the first integrated circuit is further programmed to control rotation of the first rotating platform and the second integrated circuit is further programmed to control rotation of the second rotating platform.

8. The electronic toy set of claim 2, further including a first sensor on the first electronic toy and wherein activation of the first sensor causes the first transmitter to send the first signal to the second receiver.

9. The electronic toy set of claim 8, further including a second sensor on the second electronic toy and wherein activation of the second sensor causes the second transmitter to send the second signal to the first receiver.

10. The electronic toy set of claim 8, wherein the first sensor is a motion sensor.

11. The electronic toy set of claim 10, wherein the motion sensor is tunable for direction, height and range.

12. The electronic toy set of claim 10, wherein the motion sensor is a CDS motion detector.

13. The electronic toy set of claim 8, wherein the first sensor is activated by touch.

14. The electronic toy set of claim 8, wherein the first sensor is activated by vibration.

15. The electronic toy set of claim 2, further including a third electronic toy having at least one action part, a third transmitter and third receiver, a third means for moving the action part and a third integrated circuit programmed to respond to the third receiver and control the third means for moving the action part through a third predetermined sequence and wherein the third transmitter sends a third signal to either the first or second receiver.

16. The electronic toy set of claim 15, wherein the first integrated circuit further includes a first additional predetermined sequence for execution upon reception of the third signal.

17. The electronic toy set of claim 15, wherein the second integrated circuit further includes a second additional predetermined sequence for execution upon reception of the third signal.

18. The electronic toy set of claim 2, further including a third electronic toy having at least one action part, two transmitters and two receivers, a third means for moving the action part and a third integrated circuit programmed to respond to one of the two receivers and control the third means for moving the action part through a third predetermined sequence and wherein each transmitter sends a third signal to the first and second receiver.

19. The electronic toy set of claim 18, wherein the first integrated circuit further includes a first additional predetermined sequence for execution upon reception of the third signal and the second integrated circuit further includes a second additional predetermined sequence for execution upon reception of the third signal.

20. An electronic toy set comprising:

a first electronic toy on a first rotating platform having at least one action part, a first transmitter and first receiver, a first means for moving the action part and a first integrated circuit programmed to respond to the first sensor and control the first means for moving the action part through a first predetermined sequence;

a second electronic toy on a second rotating platform having at least one action part, a second transmitter and second receiver, a second means for moving the action part and a second integrated circuit programmed to respond to the second sensor and control the second means for moving the action part through a second predetermined sequence; and wherein the first transmitter sends a first signal to the second receiver causing the second receiver to activate the second integrated circuit to move the action part of the second electronic toy through the second predetermined sequence, the second transmitter responds to the first signal by sending a second signal to the first receiver causing the first receiver to activate the first integrated circuit to move the action part of the first electronic toy through the first predetermined sequence, and the first and second predetermined sequences simulate a sword fight.

* * * * *